United States Patent [19]

Shaw

[11] 4,437,269

[45] Mar. 20, 1984

[54] ABRASIVE AND POLISHING SHEETS

[75] Inventor: George Shaw, Saffron Walden, England

[73] Assignee: S.I.A.C.O. Limited, Saffron Walden, England

[21] Appl. No.: 175,586

[22] Filed: Aug. 5, 1980

[30] Foreign Application Priority Data

Aug. 17, 1979 [GB] United Kingdom ..... 7928717
Jun. 16, 1980 [GB] United Kingdom ..... 8018597

[51] Int. Cl.[3] ..... B24D 11/02

[52] U.S. Cl. ..... 51/358; 51/296; 51/297; 51/298; 51/393; 51/394; 51/406; 51/407

[58] Field of Search ..... 51/297, 298, 358, 393, 51/394, 406, 407, 296

[56] References Cited

U.S. PATENT DOCUMENTS 3,522,681 8/1970 Lampert ..... 51/358
4,263,755 4/1981 Globus ..... 51/297

FOREIGN PATENT DOCUMENTS 1182436 6/1959 France .
446105 3/1968 Switzerland .
562611 7/1944 United Kingdom .
1083547 9/1967 United Kingdom .
1126136 9/1968 United Kingdom .
1174487 12/1969 United Kingdom .
1199940 7/1970 United Kingdom .
1205267 9/1970 United Kingdom .
1214721 12/1970 United Kingdom .

OTHER PUBLICATIONS

Hardward Trade Journal, Oct. 1979, p. 21.

*Primary Examiner*—James H. Derrington
*Attorney, Agent, or Firm*—Oldham, Oldham, Hudak, Weber & Sand Co.

[57] ABSTRACT

An abrasive or polishing sheet has indicia carried on its rear face overlaid by a translucent textile material providing a surface engageable by hooks, the material being adhered to the said indicia and their information content remain discernible through the said material. The sheet can be secured to a hooked surface of a carrier unit and can be removed therefrom and reused. The grit size indication is provided without needing to print the fabric.

The textile material is a brushed, knitted nylon having less than 20 loops or curls per square mm. A carrier pad has a material to which the sheet can be attached. The material of the pad has inclined stalks extending therefrom which have unhooked ends. These features result in a very low peel strength between sheet and pad.

15 Claims, 6 Drawing Figures

20

20

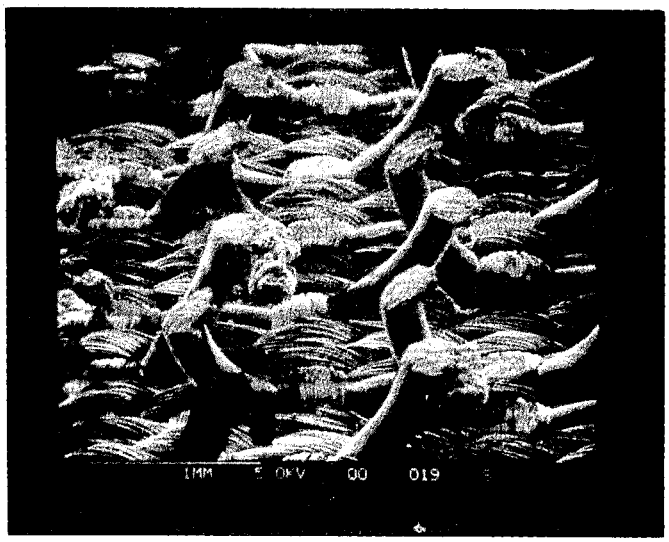
FIG. 3.
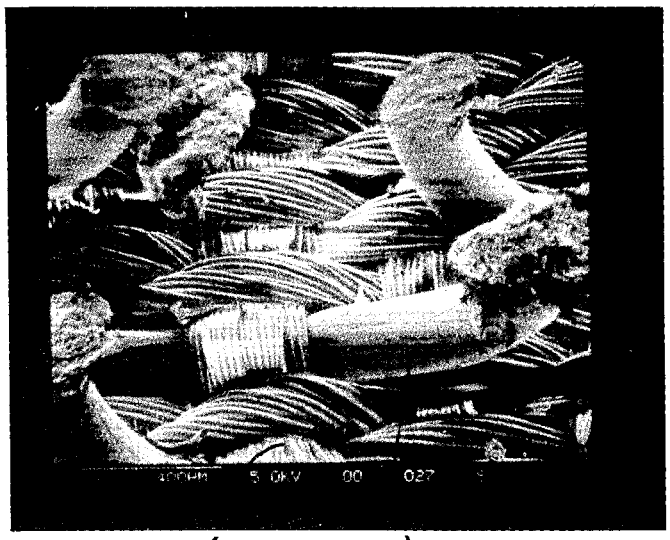
30′ FIG. 4. 32

ABRASIVE AND POLISHING SHEETS

BACKGROUND OF THE INVENTION

1. Field of the Invention

The present invention relates to abrasive or polishing sheets which can be readily exchanged for other sheets of different characteristics or for replacements when worn.

2. Description of the Prior Art

G.B. No. 1,205,267 discloses abrasive or polishing pads or discs replaceably attached to a carrier pad adapted to be mounted for rotation by a tool by providing the opposed surfaces of the disc and the pad with a plurality of interengageable self-locking fastening members. The tool carrier pad is provided with a plurality of hooks and the pads are provided with a looped mesh or fabric so that when the two are pressed together the loops fasten onto the hooks providing a self-locking fastening. A similar idea is described in G.B. No. 1,083,547. This uses a woven textile sheet which provides the hooks and this is attached to the polishing head by means of a solvent activated precoating. The pad has a textile sheet providing the loops attached to the reverse of the polishing side of the pad.

I have attempted to use conventional fasteners of this type but the looped fabric is usually about 2 or more mms thick and too bulky for this use. Such material tends to lessen the working life of the abrasive or polishing sheet, and they are also expensive. Also use of such materials requires separate provision of an indication of the abrasive or polishing grade of the sheet. This adds to the cost.

SUMMARY OF THE INVENTION

I have found surprisingly that thin light weight translucent fabrics through which one can see indicia of a size such as to allow them to be printed on the back of the disc provide sufficient interlocking capability to attach to a hooked sheet on the carrier pad whilst permitting conventional printing or grading indicia on the back of the disc to be continued to be used. Moreover thin light weight fabrics can be adhered to the disc readily with adhesives.

According to one aspect of the present invention therefore an abrasive or polishing sheet comprises a backing layer carrying an abrasive on a front face and an adhesively secured textile material on the rear face which material provides a surface engageable by hooks or the like, characterised by indicia carried on the rear face of the backing sheet e.g. to indicate the grade of abrasive, the adhesive and the textile material being of such translucency that the indicia can be seen through them.

The sheet of the present invention can be used with a carrier unit provided with a plurality of hooks or the like adapted removably to engage the engageable fibres or loops of the preferred textile material on the sheet whereby it can be removably attached to the carrier unit or pad. The sheet is readily and easily removable and replaceable on the carrier by means of the plurality of engageable fibres of the textile material on the sheet forming a self-locking fastening with the plurality of hooks on the carrier.

The peel strength between the textile material and the hooked material clearly must be less than that of the textile material to be working sheet of the hooked material to the carrier pad but must be sufficient to ensure adherence under all the working conditions and only to permit disengagement by a deliberate peeling operation. However, when the abrasive or polishing sheet is used, for example, as a disc on a polishing or sanding pad rotated at high speed and with a pressure against the article that is sanded or polished, it is found that the peel strength between the textile material and the hooked material tends to rise due to close interengagement of the hooks with the textile material to an extent very considerably in excess of the peel strength which arises from simply laying the abrasive or polishing sheet on the hooked material and smoothing it out by hand.

It is thought that the action of the pressure on the sheet during its use plus the torque exerted by the hooks on the yarn very considerably increases both the number and extent of engagement of the hooks with the yarn so increasing the peel strength as referred to above. In fact during experiments it was found that the peel strength often rose to such a degree that it was very difficult to obtain disengagement of the sheet from the hooks by a simple peeling operation.

Accordingly, another object of the present invention is so to reduce the peel strength when the sheet is initially applied to the pad that rotation of the sheet under pressure does not produce a peel strength which makes it difficult to separate the sheet from the pad by a straightforward peeling operation, when it is desired to remove the sheet e.g. for replacement purposes.

Therefore according to another aspect of the present invention an abrasive or polishing system comprises a pad adapted to be connected to a sanding or polishing tool, and an abrasive or polishing sheet arranged to be removably secured to the pad, one of the pad and the back of the sheet having a textile material adhered thereto which is made from a woven or knitted yarn having filament loops or curls extending from its surface remote from the pad or sheet, there being, on average, less than 20 loops or curls per square mm. of surface area of the sheet.

There may conveniently be on average less than 15 loops or curls per square mm. of surface area of the sheet. In an alternative embodiment there are between 4 and 18 loops or curls per square mm. and preferably between 6 and 10 loops per square mm.

According to yet another aspect of the present invention an abrasive or polishing system comprises a circular pad adapted to be connected to a power driven sanding or polishing tool and an abrasive or polishing disc arranged to be removably secured to the pad, one of the pad and the back of the disc having a textile material adhered thereto which is made from a woven or knitted yarn which has filament loops or curls extending from its surface remote from the pad or sheet, and the other of the pad and the back of the disc having a layer thereon from which extend loop-engaging or curl-engaging members in the form of mono-filament stalks having un-hooked ends.

According to a further aspect of the present invention an abrasive or polishing system comprises a pad adapted to be connected to a power driven sanding or polishing tool and an abrasive or polishing disc arranged to be removably secured to the pad, one of the pad and the back of the disc having a textile material adhered thereto which is made from a woven or knitted yarn which has filament loops or curls extending from its surface remote from the pad or disc, and the other of the pad and the back of the disc having a layer thereon from which extend loop-engaging or curl-engaging stalks having ends which face away from the layer. The stalks are preferably inclined in different directions.

The textile material is conveniently a brushed, knitted, multifilament nylon material, and the textile material is preferably prepared by knitting, brushing, stretching, and setting in that order. The textile material may be adhered to the sheet or disc by a foam latex which may be translucent, like the textile material itself, so that indicia carried by the rear face of the sheet or disc are discernible through the textile material.

The textile material may be a knitted or woven fabric e.g. of continuous or staple fibres or blends thereof e.g. weighing not more than 150 grams/sq meter e.g. in the range 25 to 100 grams/sq meter. The fabric is preferably less than 1 mm thick or is made of transparent or translucent fibres if it is thicker. The material preferably is such as to enable a person with 20/20 vision to discriminate in normal daylight between parallel dark black lines 1 mm wide and 1 mm apart and 3 mms long, and also to identify correctly numerals 1 mm thick and 4 or 5 mms high, the lines being drawn on a sheet of paper placed behind the fabric on a flat surface.

One type of satisfactory textile material is one made from multifilament nylon yarn in which individual filaments extend upwards from the plane of the fabric with their ends trapped within the yarn so as to provide an engagable portion of the fibre which is engaged by a hook will provide an interlock between the textile fabric and the hooked carrier unit. The engagable portions may extend out of the general plane of the fabric by 1, 2, 3, 4 or 5 or more times the thickness of the fabric.

The adhesive is desirably transparent and thin clear adhesives are satisfactory.

The fact that the hook elements are permanently attached to the mounting or carrier element is of no great disadvantage because the hook elements do not undergo much wear and are not in need of frequent replacement. The sheets with the abrasive or polishing surfaces on the other hand need to be frequently replaced either because they have been worn out or because a different grading or grit size of sheet is required in the sequence of one job. If the sheet is removed because a different grading or grit size is required it may be kept to one side and reused again.

The present invention overcomes the problem of discontinuous use of the sheet by permitting the user to see the grit number through the textile fabric. The abrasive or polishing surface when made is usually prepared in the form of a paper disc with the grit sizes printed on the reverse side to the working surface. There is therefore no need to reprint the markings and this reduces inventory control problems in the manufacturing process and the cost.

DESCRIPTION OF THE DRAWINGS

FIG. 3 is a perspective view of a layer of material having stalks thereon, and which is applied to an abrasive wheel, at approximately 30 fold magnification.

FIG. 4 shows part of the material of FIG. 3, at approximately 60 fold magnification.

DETAILED DESCRIPTION OF THE SPECIFIC EMBODIMENT

The photo-micrographs of FIGS. 1 to 5 were taken on a scanning electron microscope. The photo-micrographs of FIG. 5 was prepared by cutting a clean cross section through the sample of sanding disc. The surfaces to be viewed were then coated with a thin metallic, e.g. gold or palladium reflecting layer as is conventional in preparing samples for electron photomicography. A stream of electrons was then directed onto the cut surface at 45° and the electrons reflected from the surface also at 45° were collected and used to produce an optical image. It will be appreciated that the depth of focus of such photographs is very much greater than in optical photography and thus in effect one is able to see into the interior of the fabric.

Figure 6:
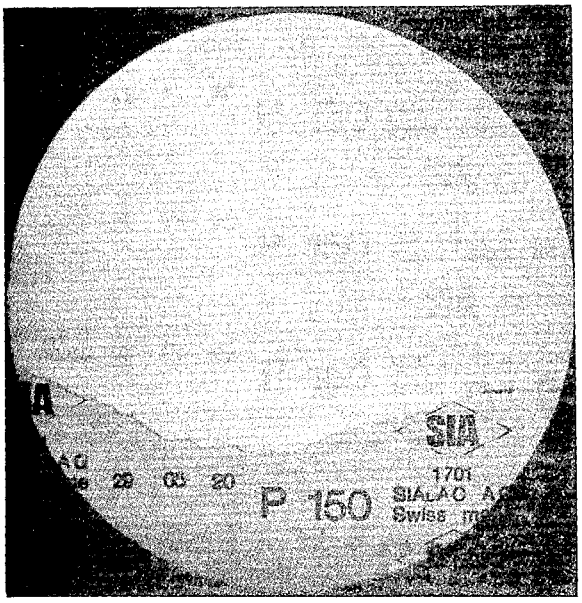
FIG. 6 is a photograph, on a slightly reduced scale of the rear of a sanding disc according to the invention, with a portion of the textile material cut away.

In the example illustrated a thin paper sheet had 150 mesh abrasive grit applied to one face in conventional manner and its rear face printed with the grit size and any other data required, such as the manufacturer's name, trade mark, and grading code for the product as shown in FIG. 6. A layer of foam latex adhesive of a transparent nature was then employed to laminate to the paper a thin textile fabric formed from brushed nylon. The adhesive was dried and the sheet cut into discs or strips. The discs are used for rotary sander pads and are cut to preferably have a slightly larger diameter than the pads with which they are to be used. Strips are used for orbital sanders which have rectangular abrasive sheets. Those printed indicia on the sheet which are to be clearly discernible e.g. the grit size (P.150), and the Trade Mark (SIA) were formed with relatively large letters for example 8 mm high and made of strokes 1 mm thick so that they could be readily seen through the fabric.

The textile fabric comprised warp-knitted 28 guage 30 denier multifilament type 66 nylon fabric. Specifically the number of filaments per strand of nylon was between 20 and 30. One surface of the material was then very lightly brushed by using either fine needles or an abrasive paper on a roll in order to draw curls or loops from the body of the knitted fabric. Whilst the knitted fabric was knitted at 126 inch width its relaxed width was 72 inches. After brushing, the material is stretched laterally to 95 inches and then heat set. This has the effect of reducing the number of curls or loops per square mm. In the example shown in FIGS. 1 and 2 the number of loops per square mm. is of the order of 8 but the invention broadly envisages a lightly brushed fabric having on average less than 20 loops or curls per square mm. of surface area of the sheet and desirably less than 15 loops or curls per square mm. of surface area of sheet. Alternatively there may on average be between 4 and 18, for example, between 6 and 10 loops or curls per square mm. of surface area of the sheet.

The weight of the resultant fabric was approximately 70 grams per square meter.

Figure 5:
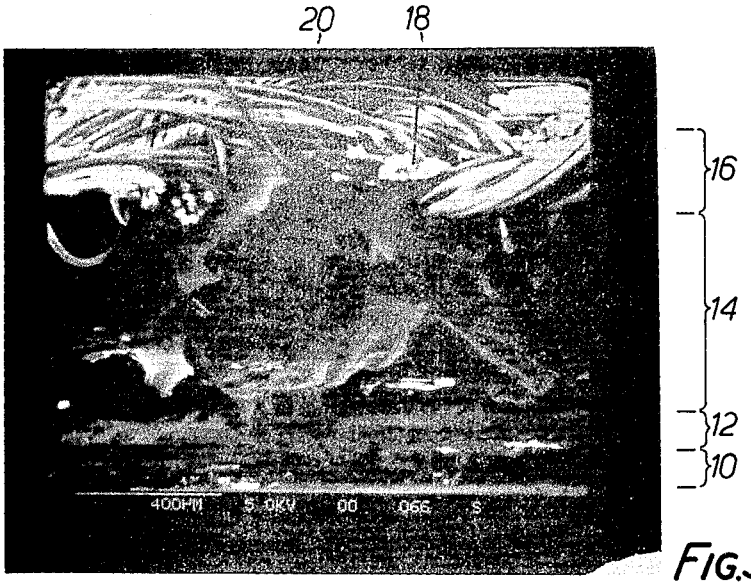
FIG. 5 is a magnified photo-micrograph of a cross section through an abrasive disc in accordance with the invention at approximately 60 fold magnification.

FIG. 5 illustrates a cross-section of a sanding disc produced in this manner and which incorporates an abrasive layer 10, a backing paper layer 12, a foam adhesive layer 14 and a fabric layer 16 which has for example a section of multifilament yarn at 18 with a number of curls 20 drawn therefrom by the brushing process outlined above. The sanding disc shown in FIG. 5 prior to sectioning and photographing, had in fact been used a number of times for experimental purposes for adhering to a pad in a manner to be described and as a consequence, the number of curls or loops 20 shown in FIG. 5 is considerably in excess of the number shown in FIGS. 1 and 2 due to further loops being drawn from the body of the fabric 16 upon separation of the disc from the pad.

Figure 1:
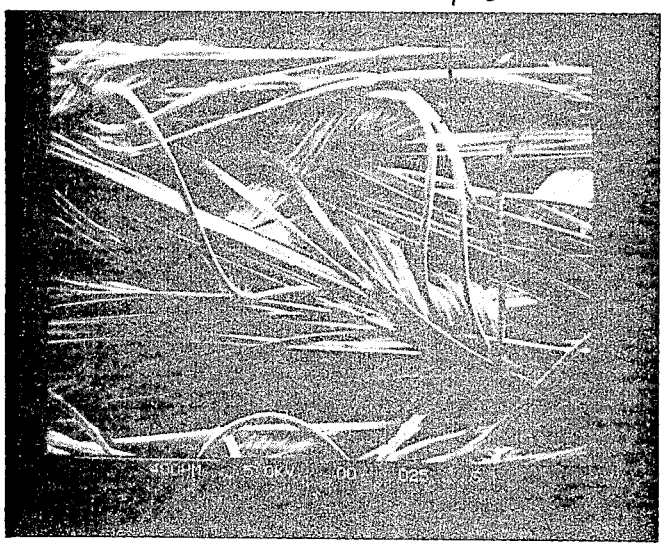
FIG. 1 is a plan view of the top free surface of a fabric to be applied to a sanding disc, at approximately 60 fold magnification.
Figure 2:
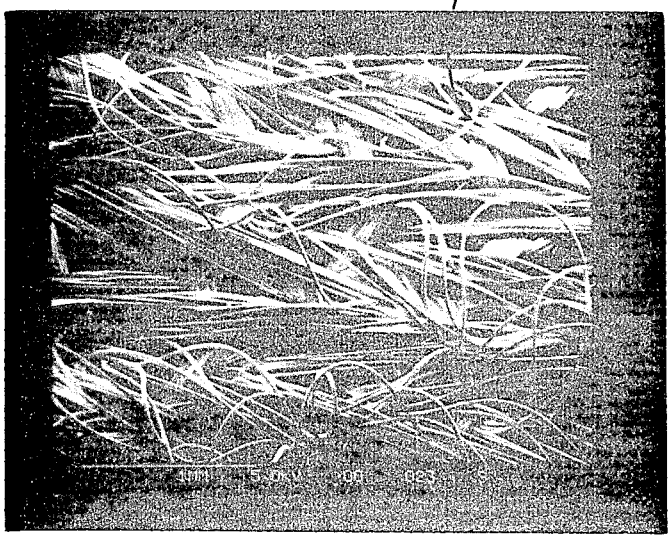
FIG. 2 shows the material of FIG. 1, at approximately 30 fold magnification.

Looking again at FIGS. 1 and 2 it will be appreciaated that the fibres which are drawn out in the form of curls or loops 20 are teased out of the main body of the fabric but these teased out fibres generally seem to have both ends retained within the fabric. The structure has a random appearance, the teased out fibres crossing each other and not being arranged in any readily discernible pattern in contrast to the basic knitted structure of the fabric which is highly ordered and made up from the knitted multifilament yarn.

FIGS. 3 and 4 show a material which can be secured to a sanding or polishing pad and which comprises a woven base layer 30 again formed from multifilament yarn and which retains rows of spaced stalk-like members 32. In contrast to many products (for example sold under the trade mark VELCRO) these stalks do not have hooked ends but their ends cut so that they face away from the body of the sheet 30 although it will be seen clearly from FIG. 3 that the stalks, whilst inclined to the vertical are inclined in different directions.

It is found that on the one hand the very low number of hoops or curls produced in the textile sheet and/or the provision of simply stalks in the adhering layer, rather than hooks, lower the peel strength of the two materials when adhering one to the other to a very considerable degree as compared with standard products. As a consequence it is found that when these materials are employed for sanding operations at high speed and at considerable pressures, whilst the peel strength after such rotation and pressure does rise, it does not rise to a level which makes it difficult to remove by a simple peeling operation by hand.

I claim:

1. An improved abrasive or polishing sheet adapted to be removably mounted on a pad which is attached to a sanding or polishing tool, said improved sheet including:

(a) a backing layer having a working surface on a front face thereof and printed indicia on a rear face thereof to indicate the grade of said working surface;

(b) a transparent adhesive on the rear face of the backing layer; and (c) a translucent textile material attached to the rear face of the backing layer by the transparent adhesive, said textile material having an exposed surface provided with a sufficient number of filament loops for releasable engagement with a plurality of fabric hooks or stalks on the tool pad for mounting the improved sheet on the pad and for permitting the printed indicia on the rear face of the backing layer to be visible through said adhesive and textile material prior to mounting said improved sheet on the tool pad.

2. The improved sheet defined in claim 1 in which there are fewer than twenty filament loops per square mm of surface area on the exposed surface of the textile material.

3. The improved sheet defined in claim 1 in which there are between six and ten filament loops per square mm of surface area on the exposed surface of the textile material.

4. The improved sheet defined in claim 1 in which there is an average of fewer than fifteen loops per square mm of surface area on the exposed surface of the textile material.

5. The improved sheet defined in claim 1 in which the textile material is a textile fabric made of a continuous filament multifilament yarn.

6. The improved sheet defined in claim 5 in which the fabric is less than 0.4 mm thick and is made from yarn having a thickness of less than 0.2 mm.

7. The improved sheet defined in claim 1 in which the adhesive is a foam latex.

8. An abrasive system including a pad adapted to be connected to a sanding tool, and an abrasive sheet arranged to be removably secured to the pad; the abrasive sheet comprising a backing layer carrying an abrasive on one side thereof with a textile material being adhered to an opposite side thereof, said textile material being made from woven or knitted yarn having filament loops or curls extending from its surface remote from the backing layer; and the pad having a woven fabric base layer which retains rows of spaced loop-engaging or curl-engaging members in the form of monofilament stalks having unhooked ends which extend in different inclined directions from the base layer for releasable securing engagement with the loops or curls of the textile material.

9. The system defined in claim 8 in which the pad is circular and the abrasive or polishing sheet is disc shaped.

10. The system defined in claim 8 in which the textile material is a brushed, knitted multifilament nylon.

11. The system defined in claim 8 in which there are, on the average, fewer than twenty loops or curls per square mm.

12. An abrasive system including a pad adapted to be connected to a sanding tool, and an abrasive sheet arranged to be removably secured to the pad; the abrasive sheet comprising a backing layer carrying an abrasive on one side thereof with a textile material being adhered to an opposite side thereof by a transparent adhesive, said textile material being made from woven or knitted yarn having filament loops or curls extending from its surface remote from the backing layer; the abrasive sheet having indicia on said opposite side which is discernible through the textile material and adhesive; and the pad having a fabric layer from which extend loop-engaging or curl-engaging members in the form of monofilament stalks having unhooked ends for releasable securing engagement with the loops or curls of the textile material.

13. An abrasive or polishing system including a pad adapted to be connected to a sanding or polishing tool, and an abrasive or polishing sheet arranged to be removably secured to the pad; the abrasive or polishing sheet having a back face with indicia thereon and a textile material adhered thereto by a transparent adhesive with the indicia being discernible through said textile material and adhesive, said textile material being made from woven or knitted yarn having filament loops or curls extending from its surface remote from the pad or sheet; and the pad having a woven fabric base layer which retains rows of spaced loop-engaging or curl engaging members in the form of monofilament stalks having unhooked ends which extend in different inclined directions from the base layer for releasable securing engagement with the loops or curls of the textile material.

14. The system defined in claim 8 in which the textile material is prepared by knitting, brushing, stretching and setting, in that order.

15. The system defined in claim 13 in which the adhesive is a latex.

* * * * *